United States Patent [19]

Stanton

[11] 4,229,851

[45] Oct. 28, 1980

[54] METHOD FOR STIFFENING SHOE INSOLES

[75] Inventor: Leo F. Stanton, Newburyport, Mass.

[73] Assignee: Bush Universal, Inc., Woburn, Mass.

[21] Appl. No.: 910,150

[22] Filed: May 30, 1978

Related U.S. Application Data

[62] Division of Ser. No. 765,095, Feb. 3, 1977, Pat. No. 4,122,573.

[51] Int. Cl.[2] ..... A43D 0/00

[52] U.S. Cl. ..... 12/146 S; 36/76 C

[58] Field of Search ..... 12/18.3, 146 S; 36/76 R, 76 C

[56] References Cited

U.S. PATENT DOCUMENTS

| | | | |
|---|---|---|---|
| 2,151,974 | 3/1939 | Kennison et al. | 12/18.3 |
| 2,294,982 | 9/1942 | Hathaway | 12/146 S |
| 2,352,520 | 6/1944 | Dawson | 12/146 S |

*Primary Examiner*—Patrick D. Lawson

*Attorney, Agent, or Firm*—Wolf, Greenfield & Sacks

[57] ABSTRACT

An apparatus for forming a shoe shank directly on the bottom of a shoe insole from a strip of initially flexible, uncured thermosetting material includes a radiant heater and resilient means for engaging the shank strip to orient, retain and resiliently urge the shank strip against the insole bottom while the radiant heater activates the shank strip.

8 Claims, 7 Drawing Figures

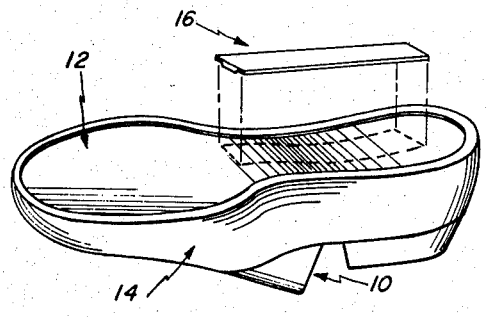
Fig. 4
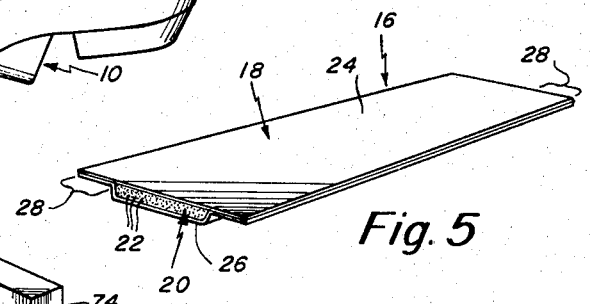
Fig. 5
Fig. 6
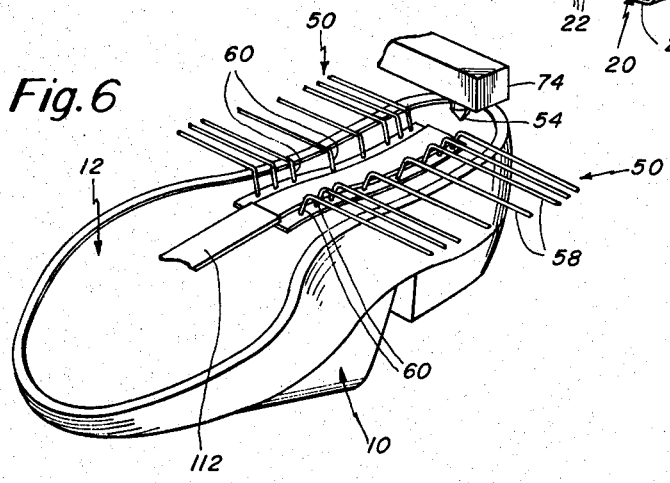
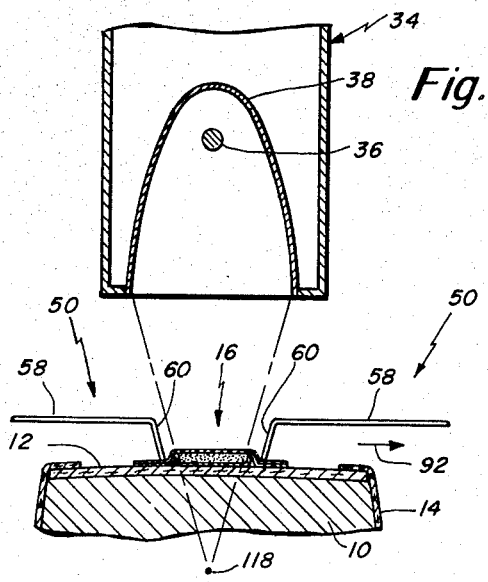
Fig. 7

METHOD FOR STIFFENING SHOE INSOLES

This is a division of application Ser. No. 765,095, filed Feb. 3, 1977, now U.S. Pat. No. 4,122,573.

BACKGROUND OF THE INVENTION

This invention relates to a method and apparatus for forming a shoe shank on the bottom of a shoe insole to stiffen the shank region which extends from the heel breast to the ball region. More particularly, the present invention is directed to a method and apparatus for applying, locating, retaining and curing a flexible strip of activatable material, such as a thermosetting resin, directly in situ on the shoe bottom so that the strip may conform to the contour of the shoe bottom and adhere thereto in its stiffened, hardened form. Such strips are described in pending U.S. Pat. application Ser. No. 681,562, filed Apr. 29, 1976 and an application filed by Robert Bradley, on even date herewith, and entitled "Stiffener For Shoes Or The Like", both of said applications being assigned to the assignee of this application.

Use of such flexible, in situ-activatable strips to form a shank stiffener solves numerous problems which have been presented in the prior art of shoe manufacture. As described in application Ser. No. 681,562, shank stiffeners typically have been inserted in shoes in the form of a stiff wood or steel preformed member. Because of the wide varieties of styles and sizes of shoes, the typical prior practice has been to require the manufacturer to maintain an inventory of a wide variety of different sizes and shapes of shanks. Numerous difficulties have been presented in the storage and proper selection and insertion of such shanks. The present invention relates to a method and apparatus by which a shank may be formed directly in place on the shoe bottom to conform precisely to the insole bottom shape and be hardened in situ thereon by an external stimulus such as radiant energy.

SUMMARY OF THE INVENTION

The apparatus of the present invention includes a radiant energy source, such as an infrared heater, which is mounted to the frame of the machine. The energy source is constructed to direct radiant energy, in a band, along the bottom of the shoe insole when the shoe assembly is in position in the machine. Means are provided for clamping the shoe assembly at a location below the radiant energy source and in a bottom-up position in which the shank strip, previously placed on the insole bottom, faces the heater and is located within the band of radiant heat. Means are provided for engaging lateral marginal portions of the shank strip to press the marginal portions toward and against the shoe bottom to cause the flexible shank strip to conform approximately to the contour of the shoe bottom but without interfering with the propagation of radiant energy to the middle portion of the shank strip which contains the activatable resin. The margin engaging means of the machine may be constructed to impart a light lateral tensioning to the sleeve of the shank strip which tends to confine and limit the volume, shape and height of the shank strip in the event that the resin might tend to expand during activation, either by bubbling or for other reasons.

The invention also relates to a method for forming a shank in which an activatable shank strip is initially placed on the insole bottom and then is carried as a unit to the machine where the shoe assembly is manually raised, bottom-up, to engage the margins of the shank strip with the resilient shank strip engaging means. The strip engaging means hold the shank strip in a fixed location with respect to the remaining portions of the machine but in a manner which permits the shoe to be moved about slightly with respect to the shank strip to enable the shoe to be positioned with some precision with respect to the shank strip. After the shoe bottom and shank strip have been manipulated into proper relative position, the shoe assembly is urged upwardly against the resilient strip engaging means and in a manner which causes a light lateral tensioning of the strip. The shoe then is clamped in that position. The radiant heater then is operated to activate the resin of the shank strip and, after activation and curing, the shoe is released and removed. It is noted that during activation and curing, at least until such time as the shank has assumed a relatively rigid final shape, the strip engaging means holds the marginal edges of the shank in a manner which will tend to tension the sleeve of the shank lightly but sufficiently to resist unwanted dimensional growth of the matrix material.

It is among the general objects of the invention to provide an apparatus and method for applying an initially flexible shank strip formed from a curable resin material to the shoe bottom.

Another object of the invention is to provide a method and apparatus of the type described which assures that the shank will conform to the contour shoe bottom and will remain attached thereto.

A further object of the invention is to provide a method and apparatus of the type described in which the shank strip is resiliently urged into conformity with the contour of the shoe bottom and further in which the covering sleeve of the shank strip may be lightly and laterally tensioned during activation of the resin.

Another object of the invention is to provide a method and apparatus of the type described which provides control over the cross sectional dimensions of the shank.

DESCRIPTION OF THE DRAWINGS

The foregoing and other objects and advantages of the invention will be appreciated more fully from the following further description thereof, with reference to the accompanying drawings wherein:

FIG. 4 is an illustration of the shoe assembly to which the shank stiffener is applied and illustrates the location of the shank stiffener;

FIG. 5 is an enlarged illustration of a portion of a shank strip as may be used;

FIG. 6 is an illustration of the shoe assembly positioned in the machine with the shank strip held in place in readiness to be activated; and FIG. 7 is a somewhat diagrammatic illustration of the strip hold down means and the radiant energy source as would be seen along the line 7—7 of FIG. 2.

DESCRIPTION OF THE PREFERRED EMBODIMENT

Figure 1:
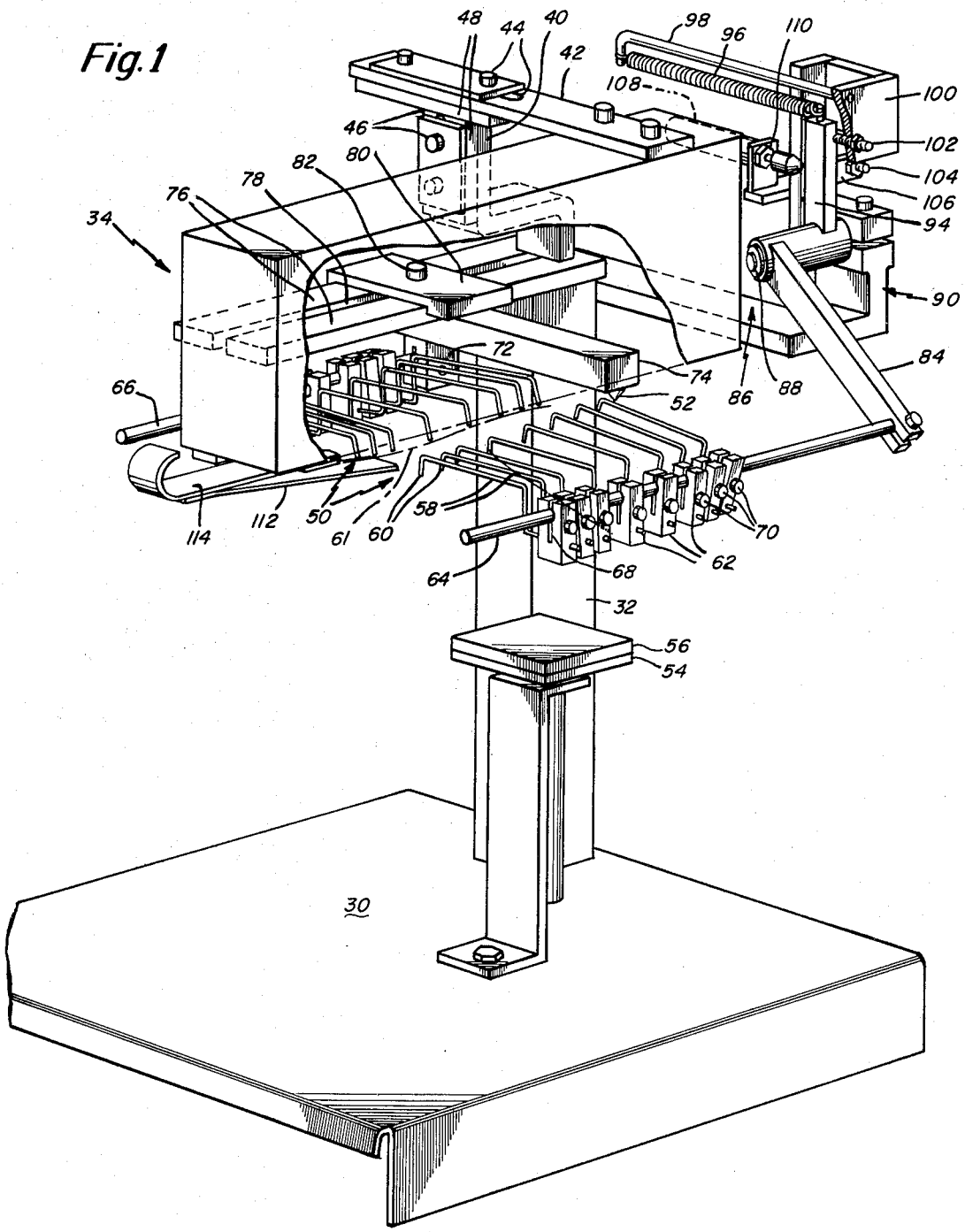
FIG. 1 is a partly broken away illustration of the machine.

The invention is concerned with locating and curing an elongate strip of material in situ on the bottom of a partially formed shoe assembly. As shown in FIG. 4, the shoe assembly includes a last 10 having an insole 12 on its bottom and an upper 14 mounted on the last 10. The marginal portions of the upper will already have been lasted to corresponding marginal portions of the insole. The shank strip 16, shown enlarged in FIG. 5, consists of an elongate sleeve 18 of flexible material which contains a matrix consisting of a thermosetting resin 20 and a multiplicity of elongate fibers 22 embedded in the matrix. The resin 20 is activatable by a selected external stimulus such as heat. Sleeve 18 preferably is formed from a pair of strips including an upper strip 24 and a lower strip 26 which are sealed to each other along their longitudinal sides to define a pair of longitudinally extending margins 28. The sleeve is formed from a material which can transmit the external activating stimulus to the resinous matrix. For example, in the embodiment described the activating stimulus is heat in the form of infrared radiant energy and the sleeve is formed from a substantially transparent plastic material which will transmit infrared radiation therethrough to the matrix.

The shank strip 16 typically will be cut from a long supply "rope" thereof and is described in detail in the aforementioned copending U. S. Pat. applications. In general, the shank strip is flexible and is cut to a length so that it may be placed on the insole bottom as suggested in FIG. 4 in which the shank strip will extend from the heel breast region of the shoe to approximately the ball portion. As will be described below in further detail, the shank strip is placed on the shoe bottom in the approximate intended location (as suggested in FIG. 4) and the shoe assembly then is brought to the machine in a bottom-up position. The machine includes means for engaging the margins 28 of the shank strip and, when the margins have thus been engaged, the shoe assembly is manipulated to position it more precisely with respect to the shank strip. The machine then clamps the shoe in that position and exposes the shank strip to the radiant energy to activate the resin and effect curing of the shank strip.

Figure 2:
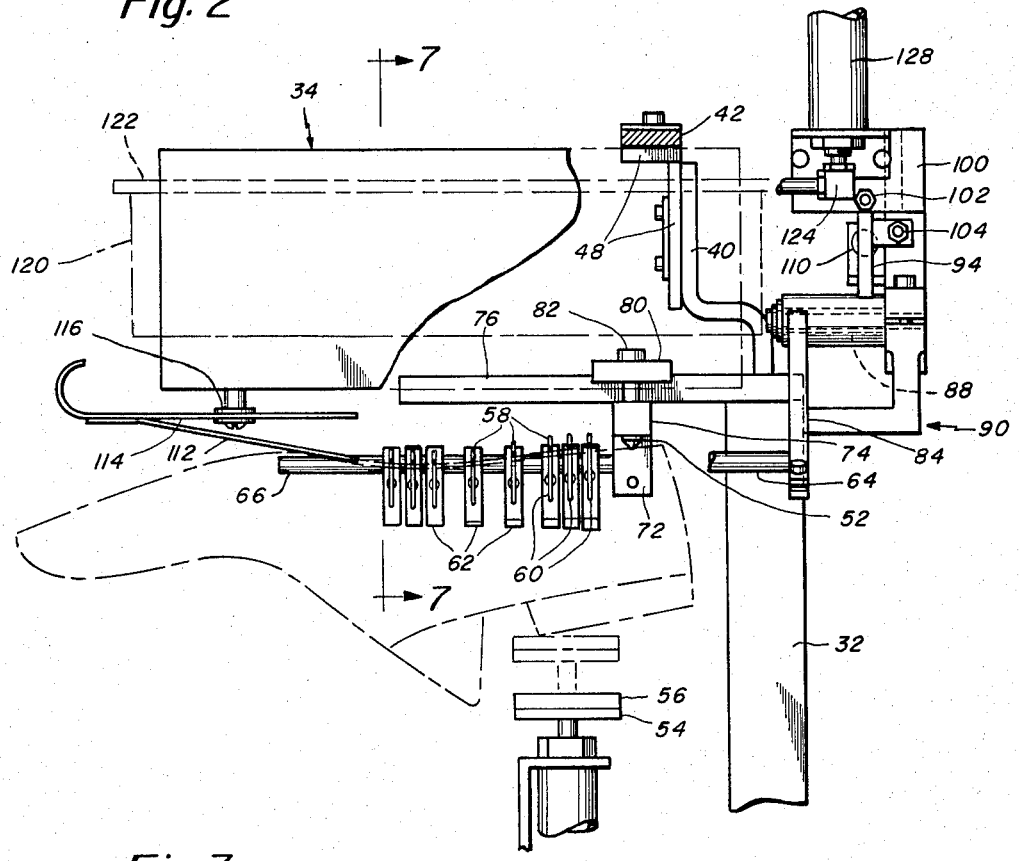
FIG. 2 is a side elevation of the machine as would be seen from the operator's position and illustrating the location of a shoe assembly in the machine.
Figure 3:
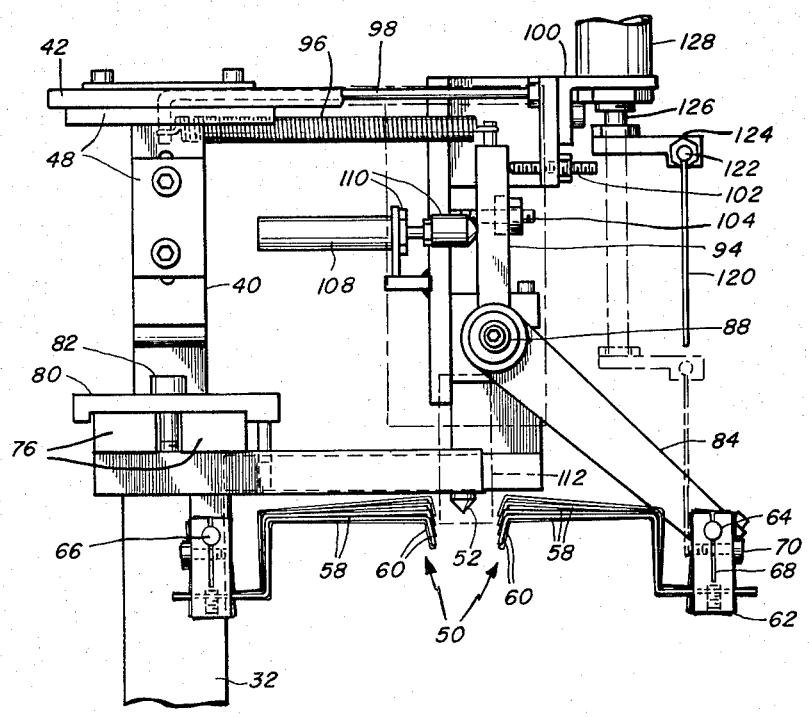
FIG. 3 is an end view of the machine as seen from the toe end thereof.

The machine is illustrated in FIGS. 1–3 and includes a base 30 and a frame 32. For ease of description, directions extending to the left as seen in FIG. 2 will be referred to as forward and toeward and directions extending to the right will be considered as heelward or rearward. Directions toward and away from the operator's normal position (in which the machine would appear as suggested in FIG. 2) will be referred to as lateral, transverse or widthwise. A radiant energy source, such as an infrared heater 34 is mounted to the frame. The heater 34 preferably is in the form of an elongate infrared heating element 36 within a reflector 38 (see FIG. 7) which will direct the infrared radiation downwardly toward a shoe assembly which is supported bottom up in the machine. The radiant heater and its reflector are selected and arranged to direct the radiant energy downwardly toward the shoe bottom when the shoe is supported in the machine in its bottom-up position below the heater (FIG. 2). As will be described, the position of the heater with respect to the shoe assembly, when the shoe assembly is positioned in readiness for activation of the shank strip, is such that the shoe bottom will be displaced from the focal point of the reflector so that the radiation from the heater will impinge on the shoe bottom in an elongate strip pattern which will substantially coincide with and include the resin-containing portions of the shank strip.

The radiant heater may be mounted to the frame, for example, by a number of brackets 40, 42 which, in turn, are supported by the frame 32. Preferably the brackets 40, 42 are secured to each other in a manner to permit either or both of the height and/or lateral location of the heater 34 to be adjusted. In the embodiment described, such adjustments may be made by a slot and screw connection, indicated generally at 44 between the brackets 40 and 42 by which the lateral position of the heater may be adjusted. Similarly, a slot and screw connection indicated generally at 46 may be employed to permit heightwise adjustment between brackets 40 and 42 and, therefore, of the heater 34. A T-shaped intermediate bracket 48 is interposed as a connector member between the brackets 40, 42.

The machine includes a pair of generally paralleling strip engaging means, indicated generally by the reference character 50, which are constructed and arranged to engage the opposite marginal portions 28 of the shank strip and urge them downwardly and resiliently into engagement with the insole bottom.

The machine also includes clamping means to secure and hold the shoe assembly in this position. The clamping means includes a heel seat pin 52 which preferably is tapered to a point and which will engage the heel seat region of the insole. Located below and slightly toewardly of the heel seat pin 52 is a vertically movable clamping member 54 covered by a resilient pad 56. After the shoe assembly has been positioned in the machine (as will be described) the heel clamp 54 is raised which will secure and lock the shoe assembly in the proper position in readiness for operation of the radiant heater and activation of the shank strip.

In the embodiment shown, the shank strip engaging means 50 includes a pair of generally paralleling rows or groups of resilient fingers 58 having ends 60 which engage the opposite margins 28 of the shank strip. The fingers 58 are arranged in two groups and each finger 58 has what may be considered as an inner, strip-engaging end, which includes the end 60 and an outer, mounted end which is secured to the mounting block 62. The mounting blocks 62 associated with each of the two groups of fingers are supported on longitudinally extending rods 64, 66 which substantially parallel the heelward-toeward direction of the machine. The rods 64, 66 are located so that when the shoe is in position on the machine, the rods 64, 66 will be spaced laterally on opposite sides of the shoe assembly. Each of the mounting blocks 62 is attached to its associated rod 64 or 66 to permit adjustment of its longitudinal as well as its angular position on the rod. To this end, each of the blocks 62 is formed with a slot 68 to define a somewhat U-shaped configuration and in which a bore is formed to receive the rods 64, 66. A locking screw 70 may extend through one of the legs of the approximately U-shaped block 62 and is threaded into the other leg to enable the block 62 to be loosened, repositioned and then retightened in place. Typically, it is preferred that the blocks 62 be initially oriented so that the strip-engaging ends 60 of the middle fingers 58 in each group extend somewhat lower than the ends 60 of the more toeward and heelwardly disposed fingers 58. Thus, the finger ends 60 in each group define a locus 61 which corresponds approximately to the curvature of the shoe bottom in the shank region of the shoe assembly. By initially arranging the locus of the ends of the fingers 60 to approximate the curvature of the shoe bottom, from the ball region to the heel breast region, a substantially uniform pressure will be applied to the margins of the shank strip when the shank strip and shoe assembly are brought into engagement with the fingers 58.

It should be noted that in the preferred embodiment, the shank-engaging end 60 of the fingers 58 terminate at a location which is disposed upwardly and inwardly of the location at which the outer ends of the fingers 58 are attached to the mounting blocks 62. This is desirable to insure that when the shoe assembly and shank strip are urged upwardly into engagement with the lower ends of the fingers, there will be no tendency for the finger ends 60 to move inwardly. Rather, as the shoe assembly is urged upwardly against the resilient finger ends 60, the ends 60 will move in a substantially upward direction. To the extent that they may have any component of lateral or transverse motion, it will be in a direction which will tend to apply a very light tension widthwise to the shank strip. This results from the fact that the finger 58, which is formed from a spring-like wire is attached at its outer end to the block 62 and the finger end 60 of each finger will tend to move in an upward and outward arcuate path from its initial position when the bottom of the shoe assembly is urged upwardly into engagement with the finger ends 60.

The other supporting rod 66 is mounted to the machine so that it may be shifted in its entirety in a heelward-toeward direction to adjust the longitudinal position of its associated fingers 58, as a group. In the embodiment shown, should it be desired to shift the longitudinal position of the other of fingers 58, the individual mounting blocks 62 must be loosened and then moved as desired. The rear rod 66 is mounted to a downwardly extending bracket 72 which, in turn, is attached to a transversely extending bar 74. The bar 74 is located heelwardly of the fingers 58. The bar 74 is mounted, in turn, to an overhead support 76 having a longitudinal slot 78. The bar 74 is secured to the support by a locking plate 80 which overlies the support 76 and is secured by a screw 82 which extends through the locking plate 80, through the slot 78 and is threaded into the bar 74. The bar 74 extends laterally (toward the operator) and the heel seat pin 52 is secured to and extends downwardly from the underside of the bar 74. The heel seat pin is disposed generally along the longitudinal centerline of the device so that it will be able to engage the center of the heel seat of the shoe assembly.

Means also are provided by which one of the groups of fingers 58 may be moved in unison so that their shank strip-engaging ends 60 may be drawn laterally away from the other group of fingers. As will be described below in more detail, this enables a light lateral tension to be applied to the sleeve of the shank strip. To this end, the rod 64 is mounted, at its heelward end, to one arm 84 of a bellcrank, indicated generally by the reference character 86. The bellcrank 86 is mounted, at a pivot 88 to a portion 90 of the frame 32 for pivotal movement about a longitudinally extending axis. As shown more clearly in FIG. 3, the pivot 88 is disposed substantially above the inner ends 60 of the fingers 58. Thus, when the bellcrank 86 is pivoted about the pin 88, the component of motion of the strip-engaging ends 60 will be substantially horizontal and in a lateral direction as suggested by the arrow 92 in FIG. 7.

As shown further in FIGS. 2 and 3, the bellcrank 86 includes an upwardly extending arm 94 which is connected, at its upper end, to a tension spring 96. The other end of the tension spring 96 is attached to a rearwardly disposed fixed member, such as the rod 98, to bias the bellcrank 86 in a direction which will tend to urge the ends 60 of the fingers 58 in a laterally outward direction suggested by the arrow 92. The rod 98 is secured to the frame of the machine as by a bracket 100. Means are provided for limiting the extent of angular movement by the bellcrank 86 to a very small range of angular movement. By way of example, the movement may be such as to permit the fingers to move about 1/32". The forward limit of rotation is determined by a set screw 102 mounted to the bracket 100 in a position to be engaged by the upwardly extending arm 94 of the bellcrank 86. The rearward limit of rotation of the bellcrank arm 94 is determined by a set screw 104 which is mounted to the arm 94 by a bracket 106. The set screw 104 is located to engage a surface of the bracket 100. Pivotal movement of the bellcrank 86, within the limits permitted by the set screws 102, 104 is controlled by a fluid cylinder 108 which also is mounted to a portion of the bracket 100. The cylinder 108 has a forwardly extending piston rod 110 which normally is extended out of the cylinder 108 into engagement with the upper bellcrank arm 94 to urge the arm 94 into engagement with the set screw 102. Should it be desired to move the fingers 58 laterally and in unison, the cylinder 108 is deactuated to permit the spring 96 to rotate the bellcrank (counterclockwise as seen in FIG. 3) to the limit as determined by set screw 104. This will cause a slight lateral movement of the fingers 58, in unison, in the direction suggested by the arrow 92.

The device also includes means for holding down the ball end (the most toeward end) of the shank strip. As shown in FIGS. 1 and 2, this arrangement includes a flexible tongue 112 which may be in the form of a leaf spring element. The tongue 112 is secured at its toeward end to a slide 114 which, in turn, is slideably received within a guide 116 secured to the lower forward end of the housing for the radiant heater 34. The slide 114 may be moved in a heelward-toeward direction to position the tongue 112 so that its outer end just overlies the ball end of the shank strip. The tongue 112 serves to hold the ball end of the shank strip downwardly against the insole and also serves to shield portions of the insole from the infrared radiation to assure that the insole will not be damaged from the heat. To the extent that the tongue 112 overlies a portion of the ball end of the shank strip, it will retard curing of that portion and will result in a flexible ball region which may be desirable in the manufacture of some shoes.

FIG. 7 illustrates the relationship between the heater, the fingers 58 and their strip-engaging ends 60 and the location of the shoe when properly positioned in the machine. The heater preferably is selected and mounted in a position in which its focal point, indicated at 118, will be disposed below the level of the insole so that the infrared radiation will be directed toward the shoe bottom in a strip having a width just slightly greater than the width defined by the middle portion of the strip which contains the curable resinous matrix.

It also is preferred to provide a safety shield 120 which, during operation of the infrared heater, can be moved into a position which will shield the operator's eyes from intense light which may be generated by the heater 34. The shield 120 has a high optical density for shielding purposes but preferably is of a density which will permit the operator to observe the heating and curing of the shank strip. The shield 120 is supported from a rod 122 which, in turn, is attached to a bracket 124. The bracket 124 is connected to the end of a downwardly extending piston rod 126 of a fluid cylinder 128. The cylinder 128, in turn, may be mounted to a stationary portion of the frame, such as the bracket 100. When the machine is idle, the cylinder 128 will be in a retracted configuration in which the shield 120 is raised to permit the operator to position the shoe assembly in the machine. Once the shoe is clamped in position, the cylinder 128 may be actuated to lower the shield 120 to the position shown in phantom in FIG. 3.

In the operation of the device, a shoe assembly, as shown in FIG. 4, is provided and a shank strip 16 of suitable length (typically of the order of four to five inches) is provided, for example, by severing from a supply length thereof. The shoe assembly is held bottom-up and the shank strip 16 is placed on the shank region of the insole in the approximately desired position, as suggested in phantom in FIG. 4. The bottom-up shoe assembly with the shank strip resting on the insole then is brought to the machine to a position below the fingers 58. The shoe assembly then is raised and is manipulated to cause the ends 60 of the fingers 58 to engage the margins 28 of the strip while the end of the ball hold down 112 overlies a small portion of the ball end of the shank. The tips of the finger ends 60 will engage the margins 28 of the strip 16 sufficiently to permit the shoe assembly to be shifted about longitudinally, laterally and angularly with respect to the shank strip 16 which is maintained in position by the finger ends 60. If desired, the tips of the fingers 60 may be sharpened somewhat to assure a positive grip on the margins 28. Once the shoe assembly has been manipulated into a proper position with respect to the shank strip, the heel end of the shoe assembly then is raised so that the heel seat portion of the insole engages the heel seat pin 52 firmly. The toe end of the shoe assembly similar is raised to bring the bottom of the shoe assembly to an approximately horizontal position so that the distance of the various portions of the shoe shank region will not vary too much from the heater. Once the shoe has been properly positioned, the clamp 54 is raised to engage the last. The resilient flexible pad 56 engages the last firmly and, in cooperation with the heel seat pin 52, secures the last in position. It should be noted that the initial, idle position of the fingers 58 is such that their ends 60 are below the intended final location of the shoe bottom so that when the shoe has been clamped in position, the fingers will resiliently bear downwardly to urge the shank strip into firm conformity with the contour of the shoe bottom. The downwardly biasing of the fingers 58 assures that the shank strip will be urged into full contact with the insole bottom, particularly as the heat is applied which, in the very early portion of the exposure cycle, will cause any portions of the shank strip which may not have fully contacted the insole bottom to become limp and fall into such contact with the insole.

After the shoe assembly and shank strip have been properly positioned and secured in the machine, the shield 120 is lowered and the radiant heater is operated to expose the shank strip to the radiant heat which is transmitted through the upper surface of the sleeve to the resin matrix. The duration of the exposure will depend on the composition of the resinous matrix and the magnitude of exothermal heat which may be generated in the curing reaction. By way of example, only an exposure time of the order of between three to seven seconds may be appropriate. The shoe assembly may be permitted to remain in the machine for a short time after exposure to permit the material to cure, in situ.

During the activation and curing of the insole, the fingers 58 hold the margins 28 firmly in place. As described in the aforementioned pending applications, the upper surface of the shank strip is selected so that it will maintain its dimensional characteristics and will not deteriorate until the resin has cured to a substantially final shape and configuration. The fingers serve to hold down the upper strip to resist expansion of the resin matrix which might occur from gases which may be generated during the reaction. Also as described in the aforementioned applications, the upper strip of the shank strip may, in some instances, be formed from a material which will shrink under the influence of heat. The fingers 58 develop sufficient downward force to hold the upper strip in position and preclude it from slipping as the heated portion of the top skin shrinks. This applies a slightly increased pressure to the resin to control and limit the height and cross sectional shape of the shank when it is finally cured. Depending on the type of material from which the shank sleeve (and particularly the upper strip) is formed, there may be some instances in which it is desirable to mechanically apply additional tension to the upper strip. Under those circumstances, one group of fingers 58 may be urged laterally and outwardly in the direction suggested by the arrow 92, by operation of the cylinder 108. The extent of such lateral force can be controlled by an appropriate adjustment of the set screws 102, 104. In most instances, when the fingers are to be moved laterally outwardly, they will only be moved to a very small fraction of an inch, for example 1/64 or 1/32 of an inch. In some instances, it may not be necessary to move the fingers 58 at all. It also should be noted that the force with which the fingers urge the strip margins into engagement with the insole bottom also may be regulated by an adjustment in the angular position of the fingers on the rods 64, 66. Should an increased force be desired, the fingers 58 may be rotatably repositioned slightly downwardly so that when the shoe is secured in the machine, it will impart a somewhat increased holding force to the margins.

As described more fully in the aforementioned copending patent applications, the cured shank strip will remain firmly bonded to the insole bottom. This may result from melting of the insole-engaging lower surface of the sleeve in which the melted portion of the sleeve cross links with the resin and also adheres to the insole bottom. Depending on the materials from which the sleeve is made, there may be instances in which it is desirable to slit the bottom surface of the sleeve to provide direct communication between the resin and the insole bottom or in other instances, an adhesive agent may be applied to the insole-engaging surface of the shank strip or to the insole bottom itself.

The ball hold down will shield that portion of the ball end of the shank strip which it overlies and, that tip portion usually will remain unactivated and non-rigid. This may be desirable in some instances because it permits a gradual reduction in the height of the shank from the cured region to the ball tip to give a smoothened, feathered construction. Also, the ball end of the shank will be highly flexible at the ball region of the shoe which is subjected to a substantial and repeated flexing when the shoe is worn. By permitting this portion of the shank to remain flexible and relatively nonrigid, the chances of the ball end of the shank stiffener striking through the insole bottom is substantially eliminated.

It should be understood that the foregoing description of the invention is intended merely to be illustrative thereof and that other embodiments and modifications may be apparent to those skilled in the art without departing from its spirit.

Having thus described the invention, what I desire to claim and secure by Letters Patent is:

1. A method for forming and applying a shank stiffener to the bottom of a shoe insole, said stiffener initially being in the form of an elongate flexible sleeve containing a flexible matrix of externally activatable thermosetting resin, said method comprising:

placing said stiffener on the bottom of said insole;

engaging longitudinally extending marginal portions of the sleeve to resiliently urge the stiffener toward and against the insole bottom to hold the sleeve in a predetermined position with respect to the insole bottom;

while maintaining the sleeve in said predetermined position, exposing the sleeve to an external stimulus capable of passing through the sleeve and activating the resin to effect curing of the resin, said sleeve being constructed in a manner in which it will become initially limp and flacid when exposed to said external stimulus;

permitting the limp and flacid insole stiffener to fall against the insole bottom to conform fully to the contour of the insole while in said limp, flacid condition; and continuing exposure of the sleeve to the external stimulus to effect curing of the resin in said insole-conforming configuration.

2. A method as defined in claim 1 wherein said external stimulus is in the form of radiant energy from a source thereof which is located in spaced relation to the stiffener.

3. A method for forming and applying a shank stiffener to the bottom of a shoe insole located at the bottom of a shoe assembly including a last, an insole on the bottom of the last and an upper mounted on the last and having its marginal portions lasted to corresponding marginal portions of the insole, said stiffener initially being in the form of an elongate flexible sleeve containing a flexible matrix of externally activatable thermosetting resin, said method comprising:

orienting the shoe assembly in a bottom-up attitude;

placing said stiffener on the bottom of the insole in an attitude and at a location which approximates the intended final location of the stiffener;

while maintaining the shoe assembly in bottom-up attitude, engaging marginal portions of the stiffener by stiffener engaging means adapted to grip and engage said stiffener and maintain it in a predetermined position;

while maintaining engagement of the stiffener with said stiffener engaging means, shifting the shoe assembly about into a selected position with respect to the engaged stiffener;

thereafter securing the shoe assembly in said selected position; and thereafter exposing said stiffener to a selected external stimulus to activate said thermosetting resin in situ on the bottom of the shoe assembly.

4. A method as defined in claim 3 wherein said external stimulus is in the form of radiant energy from a source thereof which is located in spaced relation to the stiffener.

5. A method for forming and applying a shank stiffener to the bottom of a shoe insole, said stiffener initially being in the form of an elongate flexible sleeve containing a flexible matrix of externally activatable thermosetting resin, said method comprising:

placing said stiffener on the bottom of said insole;

holding the stiffener in a predetermined position on the insole bottom by engaging longitudinally extending marginal portions of the sleeve and resiliently urging them toward and against the insole bottom;

while maintaining the stiffener in said predetermined position, applying an external stimulus to the stiffener to activate and harden the resin;

during exposure of the sleeve to the external stimulus, mechanically applying a transverse tension to the sleeve at least until said resin has assumed a substantially finan%configuration.

6. A method as defined in claim 5 wherein said external stimulus is in the form of radiant energy from a source thereof which is located in spaced relation to the stiffener.

7. A method for forming and applying a shank stiffener to the bottom of a shoe insole, said stiffener initially being in the form of an elongate flexible sleeve containing a flexible matrix of externally activatable thermosetting resin, said method comprising:

placing said stiffener on the bottom of said insole;

engaging the longitudinally extending marginal portions of the sleeve to resiliently urge the stiffener toward and against the insole bottom to hold the sleeve in a predetermined position with respect to the insole bottom;

holding down the ball end of the stiffener and simultaneously shielding said held-down end of the ball end of the stiffener from exposure to an external stimulus for activating the thermosetting resin; and exposing the stiffener to said external stimulus to activate the resin and effect curing of the unshielded portions of the resin.

8. A method as defined in claim 7 wherein said external stimulus is in the form of radiant energy from a source thereof which is located in spaced relation to the stiffener.

* * * * *

UNITED STATES PATENT AND TRADEMARK OFFICE

CERTIFICATE OF CORRECTION

PATENT NO. : 4,229,851

DATED : October 28, 1980

INVENTOR(S) : Leo F. Stanton

It is certified that error appears in the above—identified patent and that said Letters Patent is hereby corrected as shown below:

Column 6, line 11 - "by" should be --of--

Column 10, line 31 - "finan%" should be --final--

Signed and Sealed this

*Thirty-first* Day of *March 1981*

[SEAL]

*Attest:*

RENE D. TEGTMEYER

*Attesting Officer*

*Acting Commissioner of Patents and Trademarks*